US008360595B2

(12) United States Patent
Chang

(10) Patent No.: US 8,360,595 B2
(45) Date of Patent: Jan. 29, 2013

(54) LIGHT-GUIDING STRUCTURE OF TRANSLUCENT PRESS KEY

(75) Inventor: Szu-Tsung Chang, New Taipei (TW)

(73) Assignees: Inventec Appliances (Shanghai) Co., Ltd., Shanghai (CN); Inventec Appliances Corp, New Taipei (TW)

( * ) Notice: Subject to any disclaimer, the term of this patent is extended or adjusted under 35 U.S.C. 154(b) by 169 days.

(21) Appl. No.: 13/034,162

(22) Filed: Feb. 24, 2011

(65) Prior Publication Data

US 2011/0249447 A1 Oct. 13, 2011

(30) Foreign Application Priority Data

Apr. 13, 2010 (CN) ..... 2010 2 0158279 U

(51) Int. Cl.
*F21V 33/00* (2006.01)

(52) U.S. Cl. ..... 362/109; 362/29; 362/24; 362/30; 362/97.1; 362/558

(58) Field of Classification Search ..... 362/24, 362/29, 30, 97.1, 109, 558
See application file for complete search history.

(56) References Cited

U.S. PATENT DOCUMENTS

| | | | | |
|---|---|---|---|---|
| 5,568,367 | A * | 10/1996 | Park | 362/109 |
| 7,086,768 | B2 * | 8/2006 | Suwa et al. | 362/555 |
| 7,789,546 | B2 * | 9/2010 | Liu et al. | 362/555 |
| 7,893,374 | B2 * | 2/2011 | Aihara et al. | 200/314 |
| 7,905,627 | B2 * | 3/2011 | Chiang et al. | 362/237 |
| 2003/0090885 | A1 * | 5/2003 | Hsu | 362/24 |

* cited by examiner

*Primary Examiner* — Ali Alavi
(74) *Attorney, Agent, or Firm* — WPAT, P.C.; Anthony King

(57) ABSTRACT

The present invention discloses a light-guiding structure of a translucent press key including a keypad region including a circular hollow area, and a diffuser and a light source module sequentially disposed below the keypad region. The light source module includes a reflective film and a light generating unit, in which the reflective film has a through hole formed at a position opposite to the middle of the circular hollow area, and the light generating unit is coupled to a control circuit of the keypad region and generates a light source to pass through the through hole. The light-guiding structure of a translucent press key of the present invention has the advantages of a low cost and highly uniform light distribution.

19 Claims, 5 Drawing Sheets

LIGHT-GUIDING STRUCTURE OF TRANSLUCENT PRESS KEY

BACKGROUND OF THE INVENTION

1. Field of the Invention

The present invention relates to a light-guiding structure of a translucent press key, and more particularly to a light-guiding structure providing uniform light in a large area and translucent keys.

2. Description of the Related Art

Most conventional circular light-guiding structures come with the following two types of structures:

1. In a light-guiding structure, a plastic body is generally used as a light-guiding and reflective structure, and two light emitting diodes (LEDs) are installed at two symmetric points under the plastic body to serve as a light source, and a physical press key is installed at the center of the press key and provided for connection. However, such structure has the drawback that the area near the LEDs is extremely bright, such that it causes a problem of non-uniform light. With reference to FIG. 1 for a cross-sectional view of a conventional light-guiding structure, the physical press key 11 is installed above the light-guiding structure, and two LEDs 12 are installed around the periphery below the light guide. The light guide is too bright at the position near the LEDs and too dark at a position far from the LEDs, and thus the light guided by the conventional light-guiding structure has a poor uniformity.

2. With reference to FIG. 2 for a schematic view of a conventional thin light guide film (LGF) structure generally applicable for a light guide system with insufficient space, and the LGF structure usually adopts a sidelight LED 21 installed on a thin film LGF 22, and micro-dots or micro etched marks for reflecting light are printed on the LGF 22 for improving the reflection efficiency to allow light to be uniformly diffused in the structure. If the distance between the LED 21 and the visual appearance area 23 is insufficient, the visual appearance of the area near the LED 21 may be too-bright. To avoid this problem, a specific distance should be maintained between the visual appearance area 23 and the LED 21, such that the area near the LED 21 will not be too bright, and the light-guiding structure will not have the limitation and inconvenience of its installation.

In summation of the description above, we can find that the light near the LEDs is not uniform distribution, and the distance between the LEDs and the visual appearance area is insufficient will cause a too-bright condition, and this problem generally exists in the light-guiding structures of prior arts. Therefore, a novel light-guiding structure is developed and introduced to overcome the aforementioned problem.

SUMMARY OF THE INVENTION

Therefore, it is a primary objective of the invention to provide a light-guiding structure of a translucent press key to overcome the problems of the prior art described above, and achieve the uniform light effect with a low cost.

The technical measures taken by the present invention are elaborated as follows:

A light-guiding structure of a translucent press key comprises a keypad region, a diffuser, and a light source module. The keypad region has at least one circular hollow area and a control circuit for transmitting or receiving a signal. The diffuser is installed below the keypad region. The light source module is installed below the diffuser, and includes a reflective film and a light generating unit. The reflective film has a through hole formed at a position opposite to the middle of the circular hollow area. The light generating unit is disposed in the through hole, and is coupled to the control circuit.

Wherein, the light generating unit generates a light source according to the signal, and the light source is reflected from the reflective film into the diffuser, and diffused uniformly from the diffuser to the keypad region.

In a preferred embodiment of the present invention, the light generating unit is a straight-up light source that can be diffused in 360 degrees to facilitate a diffusion of the light source to a large area in different directions.

Preferably, the light generating unit of the present invention includes one or more light emitting diodes (LED), and an appropriate number of LEDs used based on the size of a light emitting area will reduce or eliminate non-uniform lights.

Preferably, the diffuser of the present invention is made of a synthetic rubber or thermo plastic urethane (TPU) material with a light reflective semi-translucent conductivity and provided as a light-guiding plate for conducting the diffused light of the LED.

Preferably, the keypad region of the present invention further includes a patterned hollow area disposed in the circular hollow area and above the light generating unit.

The present invention may further comprise a light shading film disposed above the light source module and between the diffuser and the keypad region. If the patterned hollow area above the light generating unit requires light to pass therethrough, the light shading film can reduce the strong light from the light generating unit to control the light uniformity of the patterned hollow area.

Preferably, the light shading film includes a porous mesh fabric.

Preferably, the keypad region of the present invention is a touch panel.

Another object of the present invention is to provide a handheld device. The handheld device comprises a housing and a light-guiding structure disposed on the housing. The light-guiding structure comprises a keypad region, a diffuser, and a light source module. The keypad region includes a circular hollow area and a control circuit for transmitting or receiving a signal. The diffuser is installed below the keypad region. The light source module is installed below the diffuser and includes a reflective film and a light generating unit. The reflective film has a through hole formed at a position opposite to the middle of the circular hollow area; the light generating unit is disposed in the through hole, and is coupled to the control circuit. Wherein the light generating unit generates a light source according to the signal, and the light source is reflected from the reflective film into the diffuser and diffused uniformly from the diffuser to the keypad region.

In the handheld device, the light generating unit may be a straight-up light source.

In the handheld device, the light generating unit may include one or more light emitting diodes.

In the handheld device, the diffuser may be made of a synthetic rubber or thermo plastic urethane material with a light reflective semi-translucent conductivity.

In the handheld device, the keypad region may further include a patterned hollow area disposed in the circular hollow area. The light-guiding structure may further comprise a light shading film disposed above the light source module and between the diffuser and the keypad region.

In the handheld device, the light shading film may include a porous mesh fabric.

In the handheld device, the keypad region may include a touch panel, and the signal is generated by touching the touch panel.

Compared with the prior art, the technical solution of the present invention has the following effects and advantages: The light-guiding structure of a translucent press key of the present invention overcomes the problems of LED with the bright spot buffer of a light guide film (LGF) to achieve a uniform light-guiding structure with the lower cost.

DETAILED DESCRIPTION OF THE PREFERRED EMBODIMENTS

The technical measures taken by the present invention to achieve the foregoing objectives and effects will become apparent with the detailed description of preferred embodiments together with related drawings as follows.

Figure 1:
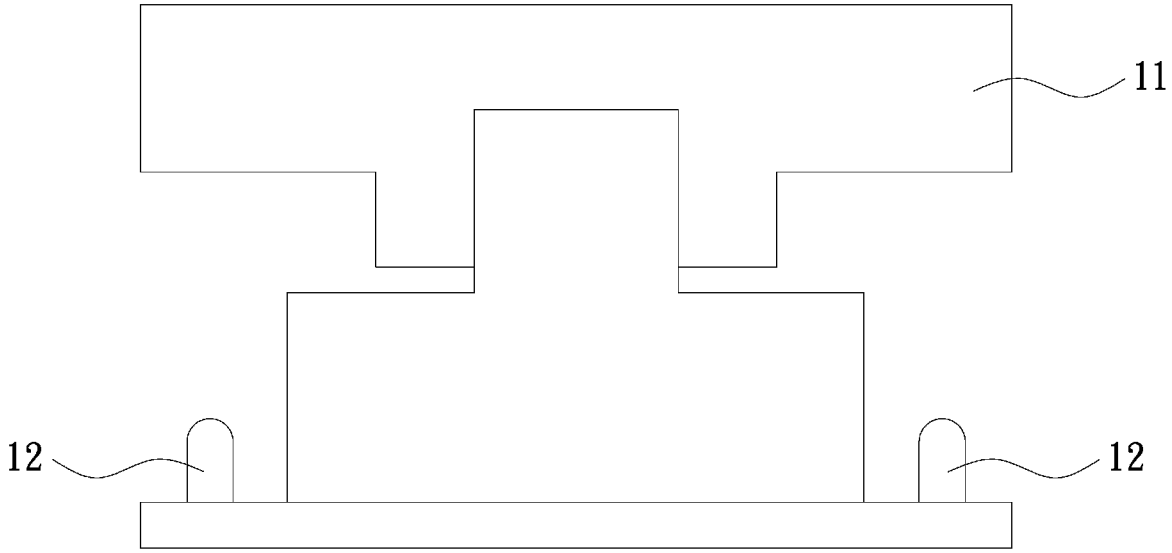
FIG. 1 (Prior Art)
FIG. 1 is a cross-sectional view of a conventional light-guiding tube.
Figure 2:
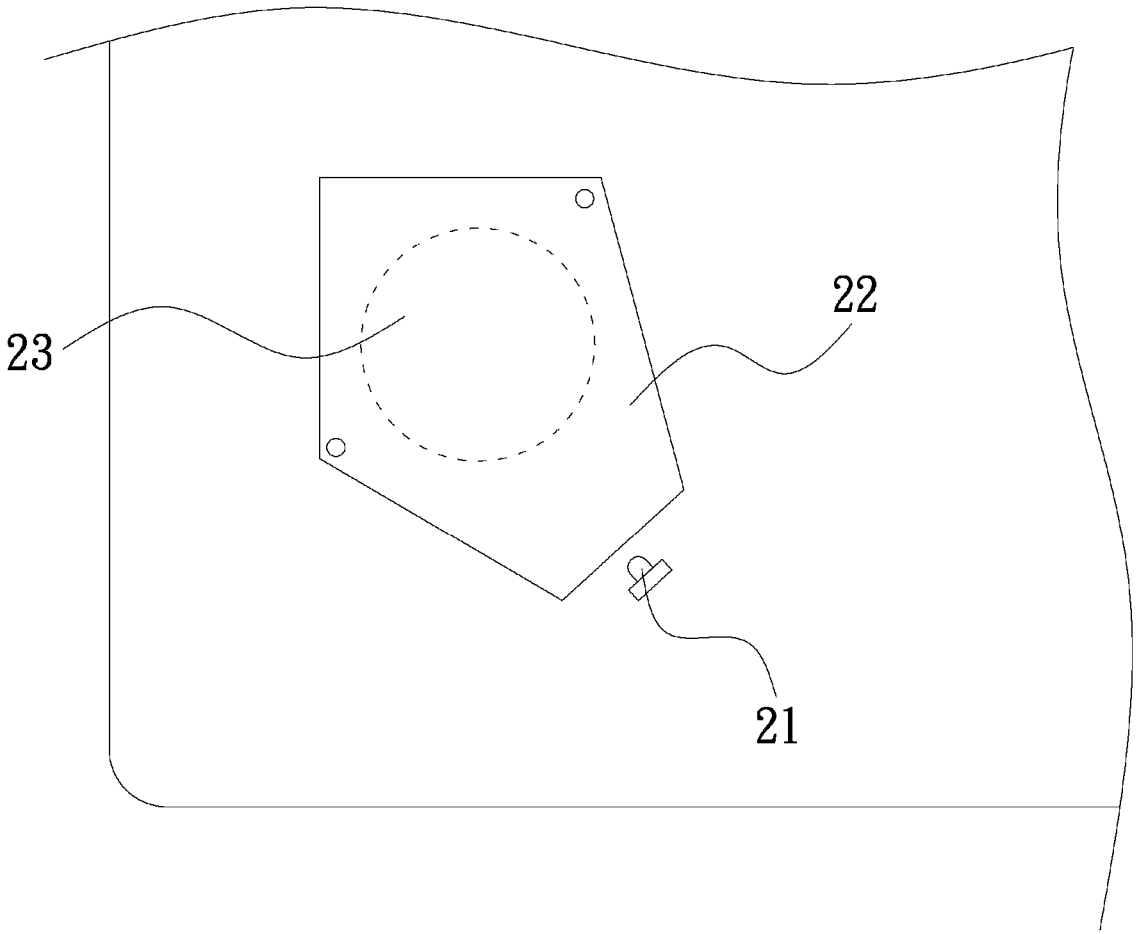
FIG. 2 (Prior Art)
FIG. 2 is a schematic view of a light-guiding structure of a conventional light-guiding film.
Figure 3A:
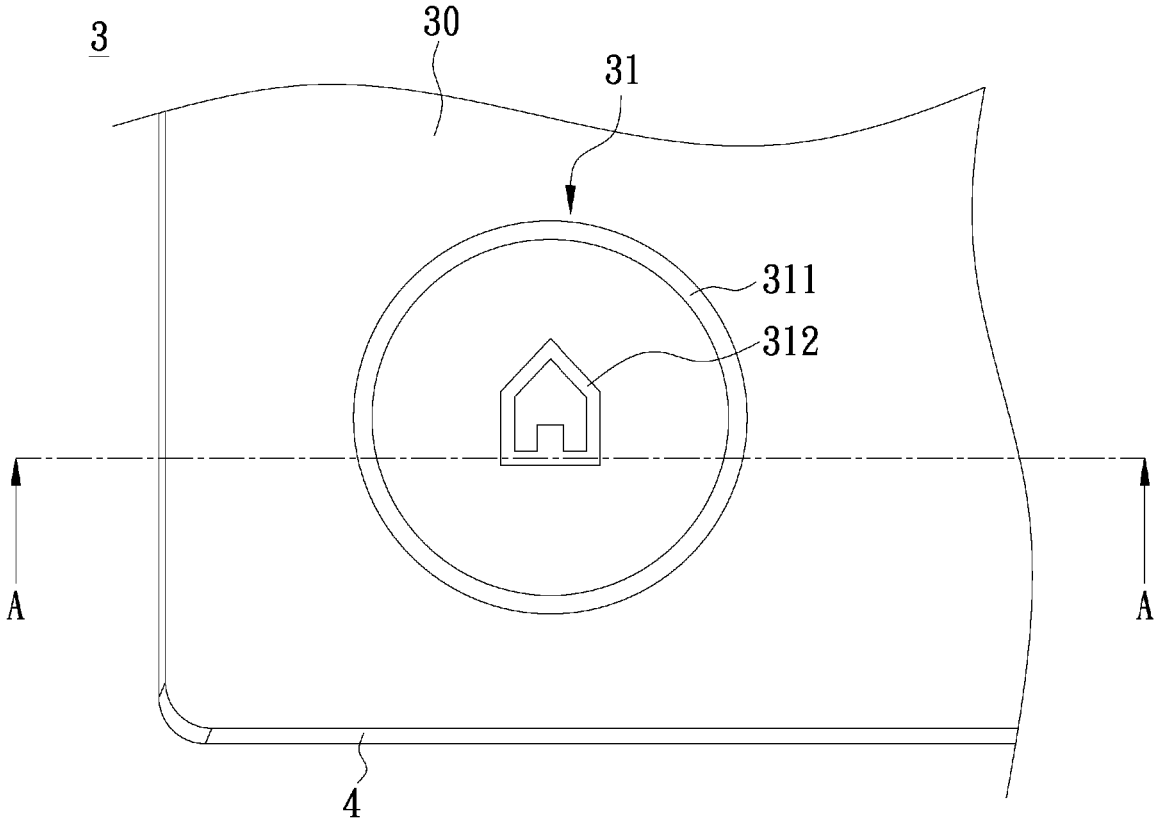
FIG. 3*a* is a top view of a portion of a first preferred embodiment of the present invention.
Figure 3B:
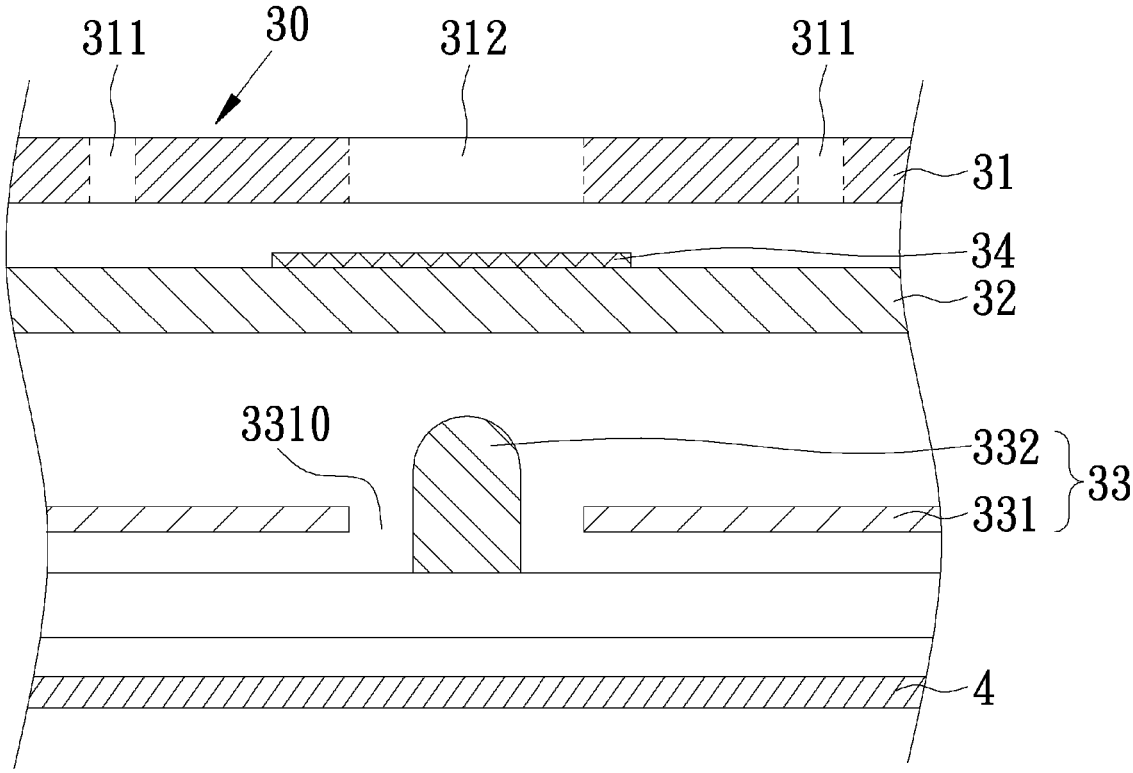
FIG. 3*b* is a cross-sectional view of Section A-A of the first preferred embodiment of the present invention.

With reference to FIGS. 3*a* and 3*b* for a handheld device in accordance with a first preferred embodiment of the present invention, the handheld device can be a mobile phone, personal digital assistant, a tablet PC or a game controller. In this embodiment, the handheld device is a mobile phone. The mobile phone 3 comprises a housing 4 and a touch panel 30 with translucent press keys including a light-guiding structure disposed on the housing 4. The light-guiding structure comprises a keypad region 31, a diffuser 32, and a light source module 33. The keypad region 31 can be a touch panel. In this embodiment, the keypad region 31 is a portion of the touch panel 30. The keypad region 31 has a circular hollow area 311, and a control circuit (not shown) for transmitting or receiving a signal from the keypad region 31. Moreover, the keypad region 31 further comprises a patterned hollow area 312 used as a decoration when light is emitted in the keypad region 31, wherein the patterned hollow area 312 can be designed with a special figure in order to improve the readability of the figure when the figure is lit. In the first preferred embodiment, the patterned hollow area 312 is disposed at a central position of the circular hollow area 311, and is in the shape of a house provided as a pattern for indicating the keypad region 31. The diffuser 32 and the light source module 33 are sequentially disposed below the keypad region 31. The light source module 33 includes a reflective film 331 and a light generating unit 332, wherein the reflective film 331 has a through hole 3310 formed at a position opposite to the middle of the circular hollow area 311, and the light generating unit 332 is disposed in the through hole 3310 and is coupled to the control circuit. In this preferred embodiment, the light generating unit 332 can generate a straight-up type light source which can be indicated by a light emitting diode (LED). In other words, the light generating unit 332 may include one or more LEDs. When the light generating unit 332 generates a light source according to the signal, the light source can be reflected from the reflective film 331 into the diffuser 32, and diffused uniformly from the diffuser 32 to the keypad region 31 since the light generating unit 332 is disposed in the through hole 3310.

In this preferred embodiment, the diffuser 32 can be made of a synthetic rubber or thermo plastic urethane (TPU) material with a light reflective semi-translucent conductivity. The reflective film 331 disposed below the diffuser 32 is provided for increasing the total reflection of the light source, such that when a light source enters into the diffuser 32, the light guiding efficiency is increased. The light generating unit 332 used in this preferred embodiment is a straight-up type LED light source that can be diffused in 360 degrees and is disposed in the through hole 3310 as mentioned above, such that the light source can be spread out widely in different directions, and can be reflected into the diffuser 32 with the shortest light path.

The patterned hollow area 312 above the light generating unit 332 is provided for light to transmit through. In addition, a light shading film 34 is disposed above the light generating unit 332 when there is the patterned hollow area 312 above the light generating unit 332. If the light generating unit 332 has no patterned hollow area 312 thereon, then it is not necessary to transmit any light, and there is not necessary to use the light-shielding film 34. The light shading film 34 having a dulling material is used for weakening the strong light coming from the concentrated light source above the light generating unit 332 that causes a too-bright area. In this preferred embodiment, there is the patterned hollow area 312 in the shape of a house disposed above the light generating unit 332, so that the light shading film 34 is needed to be disposed between the diffuser 32 and the keypad region 31 in order to block the light from the light generating unit 332, such that the circular hollow area 311 and the patterned hollow area 312 can achieve the uniform light effect. However, the present invention is not limited to such arrangement only.

The dulling material can be a diffusion film, a piece of paper, or a semi-transparent material such as mylar, but the aforementioned materials have their own natural colors and will change the color temperature of the light emitted by the light generating unit 332 (which is an LED). A piece of porous net cloth can be used to reduce the luminance of the light source in order to control the intensity of the emitted light of the patterned hollow area 312. The higher the porosity, the greater the light emitting intensity is. Therefore, the luminance of the patterned hollow area 312 (which is above the LED as shown in the figure) can be controlled, so that the brightness of the patterned hollow area 312 is similar to the brightness of the circular hollow area 311 to achieve the design requirements for uniform light and uniform color temperature.

Figure 4:
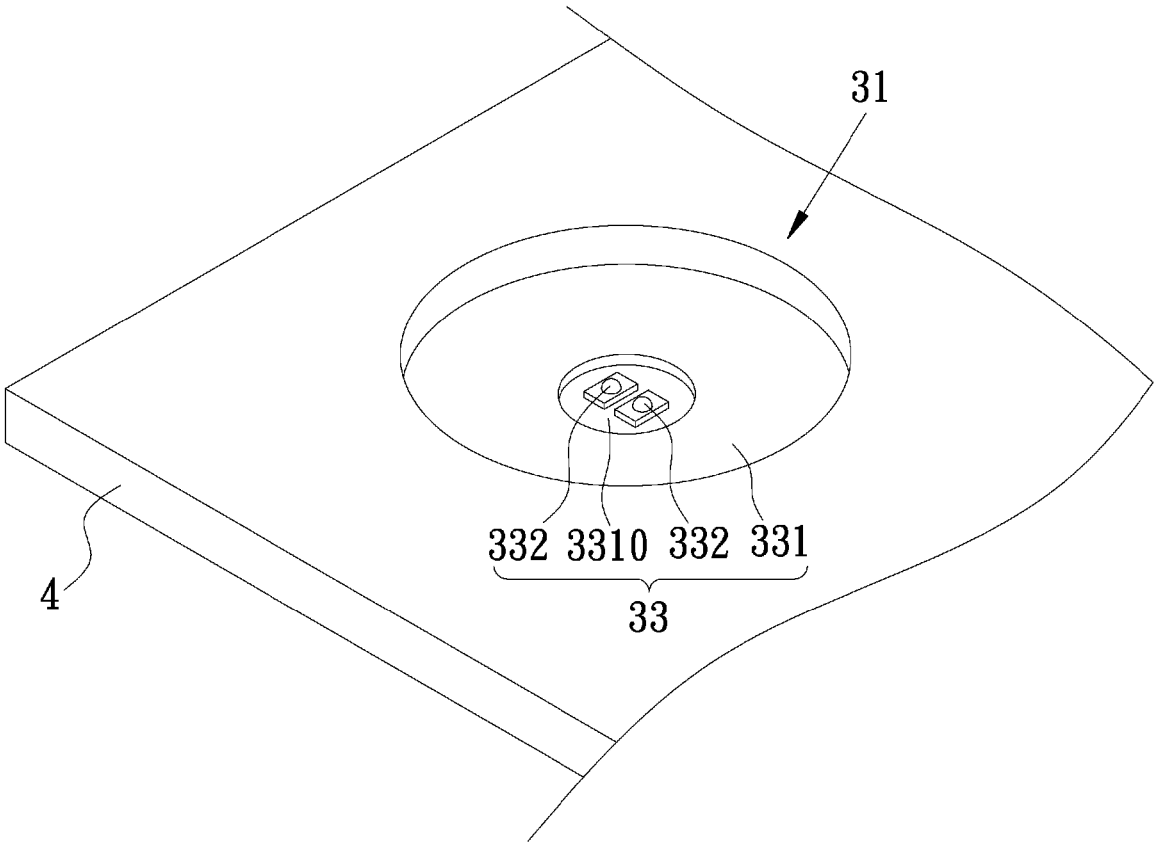
FIG. 4 is a schematic view of a light generating unit of a second preferred embodiment of the present invention.

With reference to FIG. 4 for a schematic view of a light generating unit of a second preferred embodiment of the present invention, a light source module 33 is installed in a keypad region 31 of a mobile phone housing 4, and includes a reflective film 331 having a through hole 3310 for installing a light generating unit 332 therein. The structure and assembly of the second preferred embodiment is the same as those of the first preferred embodiment, and thus will not be described here again. The difference between the first preferred embodiment and the second preferred embodiment is that the appropriate number of light generating units 332 used in the second preferred embodiment depends on the size of the light emitting light area, wherein two light generating units 332 are used in the second preferred embodiment, and light generating units 332 include but not limited to LEDs.

While the invention has been described by means of specific embodiments, numerous modifications and variations could be made thereto by those skilled in the art without departing from the scope and spirit of the invention set forth in the claims.

What is claimed is:

1. A light-guiding structure of a translucent press key, comprising:

a keypad region including a circular hollow area and a control circuit for transmitting or receiving a signal;

a diffuser installed below the keypad region; and a light source module installed below the diffuser and including:

a reflective film having a through hole formed at a position opposite to the middle of the circular hollow area; and a light generating unit disposed in the through hole, and the light generating unit being coupled to the control circuit;

wherein the light generating unit generates a light source according to the signal, and the light source is reflected from the reflective film into the diffuser and diffused uniformly from the diffuser to the keypad region.

2. The light-guiding structure of a translucent press key as recited in claim 1, wherein the light generating unit is a straight-up light source.

3. The light-guiding structure of a translucent press key as recited in claim 2, wherein the light generating unit includes one or more light emitting diodes.

4. The light-guiding structure of a translucent press key as recited in claim 1, wherein the diffuser is made of a synthetic rubber or thermo plastic urethane material with a light reflective semi-translucent conductivity.

5. The light-guiding structure of a translucent press key as recited in claim 1, wherein the keypad region further includes a patterned hollow area disposed in the circular hollow area.

6. The light-guiding structure of a translucent press key as recited in claim 5, further comprising a light shading film disposed above the light source module and between the diffuser and the keypad region.

7. The light-guiding structure of a translucent press key as recited in claim 6, wherein the light shading film includes a porous mesh fabric.

8. The light-guiding structure of a translucent press key as recited in claim 1, wherein the keypad region includes a touch panel.

9. The light-guiding structure of a translucent press key as recited in claim 8, wherein the signal is generated by touching the touch panel.

10. A handheld device, comprising:

a housing; and a light-guiding structure disposed on the housing, comprising:

a keypad region including a circular hollow area and a control circuit;

a diffuser installed below the keypad region; and a light source module installed below the diffuser and including:

a reflective film having a through hole formed at a position opposite to the middle of the circular hollow area; and a light generating unit disposed in the through hole, and the light generating unit being coupled to the control circuit;

wherein the light generating unit generates a light source, and the light source is reflected from the reflective film into the diffuser and diffused uniformly from the diffuser to the keypad region.

11. The handheld device as recited in claim 10, wherein the light generating unit is a straight-up light source.

12. The handheld device as recited in claim 11, wherein the light generating unit includes one or more light emitting diodes.

13. The handheld device as recited in claim 10, wherein the diffuser is made of a synthetic rubber or thermo plastic urethane material with a light reflective semi-translucent conductivity.

14. The handheld device as recited in claim 10, wherein the keypad region further includes a patterned hollow area disposed in the circular hollow area.

15. The handheld device as recited in claim 14, wherein the light-guiding structure further comprises a light shading film disposed above the light source module and between the diffuser and the keypad region.

16. The handheld device as recited in claim 15, wherein the light shading film includes a porous mesh fabric.

17. The handheld device as recited in claim 10, wherein the keypad region includes a touch panel.

18. The handheld device as recited in claim 10, wherein the signal is generated by touching the touch panel.

19. The handheld device as recited in claim 10, being a mobile phone, personal digital assistant, a tablet PC or a game controller.

* * * * *